US008844084B2

(12) United States Patent
Allen

(10) Patent No.: US 8,844,084 B2
(45) Date of Patent: Sep. 30, 2014

(54) POST AND HAND RAIL ASSEMBLY FOR MODULAR RAMP

(71) Applicant: Prairie View Industries, Inc., Fairbury, NE (US)

(72) Inventor: Richard Allen, Fairbury, NE (US)

(73) Assignee: Prairie View Industries, Inc., Fairbury, NE (US)

( * ) Notice: Subject to any disclaimer, the term of this patent is extended or adjusted under 35 U.S.C. 154(b) by 0 days.

(21) Appl. No.: 13/705,915

(22) Filed: Dec. 5, 2012

(65) Prior Publication Data

US 2014/0150188 A1 Jun. 5, 2014

(51) Int. Cl.

| | |
|---|---|
| ***E04H 17/24*** | (2006.01) |
| ***F16B 7/04*** | (2006.01) |
| ***E04H 17/20*** | (2006.01) |
| ***E01D 15/12*** | (2006.01) |

(52) U.S. Cl.

CPC ..... *E04H 17/20* (2013.01); *E01D 15/12* (2013.01)

USPC ..... 14/69.5; 256/68; 256/65.02; 256/65.03; 256/65.06; 256/65.07; 403/170; 403/292

(58) Field of Classification Search

USPC ..... 256/68, 69, 65.01–65.08; 14/69.5; D8/396; 403/170, 186, 217, 286, 292

See application file for complete search history.

(56) References Cited

U.S. PATENT DOCUMENTS

| | | | | |
|---|---|---|---|---|
| 2,834,621 | A * | 5/1958 | Schroer | 403/188 |
| 4,283,152 | A * | 8/1981 | Smith et al. | 403/3 |
| 5,144,780 | A * | 9/1992 | Gieling et al. | 52/298 |
| 5,584,469 | A * | 12/1996 | Goodwin | 256/67 |
| 6,634,823 | B2 * | 10/2003 | Sciortino | 403/13 |
| D506,385 | S * | 6/2005 | Brown | D8/396 |
| 2007/0257245 | A1 * | 11/2007 | Patterson | 256/65.07 |

OTHER PUBLICATIONS

Prairie View Industries, Inc., Modular XP System Manual, Aug. 2011.

Prairie View Industries, Inc., Original Modular Ramp and Modular XP, publically available prior to Dec. 5, 2011, pp. 15-17.

* cited by examiner

*Primary Examiner* — Gary Hartmann

(74) *Attorney, Agent, or Firm* — Stinson Leonard Street LLP

(57) ABSTRACT

A hand rail to post connector assembly for use with a modular ramp. The assembly includes a post cap configured for mounting to a post, a saddle that is received by a slot in the post cap, and a rail insert that is secured to the saddle. The post cap includes a support surface configured to support a hand rail, and the post cap substantially constrains the saddle from moving vertically. The rail insert has a clamping surface that engages an inner surface of the hand rail for clamping the hand rail between it and the saddle.

21 Claims, 8 Drawing Sheets

POST AND HAND RAIL ASSEMBLY FOR MODULAR RAMP

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention is directed toward a modular ramp assembly, and in particular, to a hand rail to post connector assembly for use with a modular ramp assembly.

2. Description of Related Art

Modular ramps have been developed to enhance the accessibility of doorways or other structures that are elevated above ground level. The ramps are typically manufactured in sections that are transported to the location where they are assembled for use. Hand rails are often mounted to the ramps for safety and to comply with laws and regulations. The hand rails are typically permanently secured to posts which are mounted to and extend upward from the ramp surface. Conventionally, the hand rails are welded to the posts to form a unitary structure. While welding the hand rails to the posts provides a stable and secure structure, it is difficult to quickly modify the length of the hand rails to adapt them to a particular location. The unitary design also makes it difficult to transport the hand rails and posts. Further, if it is necessary or desirable to paint the hand rails, the posts must also be painted since they form an integral structure with the hand rails.

BRIEF SUMMARY OF THE INVENTION

The present invention is directed toward a hand rail to post connector assembly. The hand rail to post connector assembly includes a post cap configured to mount to a post, a saddle that is received by a slot in the post cap, and a rail insert that is secured to the saddle. The post cap includes a support surface configured to support a hand rail, and the post cap substantially constrains the saddle from moving vertically. The rail insert has a clamping surface that engages an inner surface of the hand rail for clamping the hand rail between it and the saddle.

The post cap support surface and rail insert clamping surface are preferably curved for supporting and engaging a hand rail having a circular cross-section. However, it is within the scope of the invention for the post cap and rail insert to be configured for supporting and engaging any type of hand rail, such as a hand rail having a square cross-section. The assembly also preferably includes a second rail insert that is secured to the saddle for clamping a second hand rail between it and the saddle. The hand rail to post connector assembly may be used to securely join the hand rails of a modular ramp to the posts during installation of the ramp. It also permits an installer to quickly modify the length of hand rail sections as desired, and allows the hand rails to be painted separate from the posts.

The present invention also encompasses a post and hand rail assembly that includes a post, an upper hand rail and the components of the hand rail to post connector assembly described above. The post and hand rail assembly may additionally include a lower hand rail that is received by openings in the post and joined to the post with a fastener. Preferably, the assembly has two posts each joined to the post cap, and two lower hand rails each received by a pair of openings in one of the posts.

In another aspect, the present invention encompasses a modular ramp assembly that includes a ramp and the components of the post and hand rail assembly described above. The ramp includes a substantially planar surface and a pair of frame rails each joined with one side of the planar surface. The posts are mounted to the frame rails.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
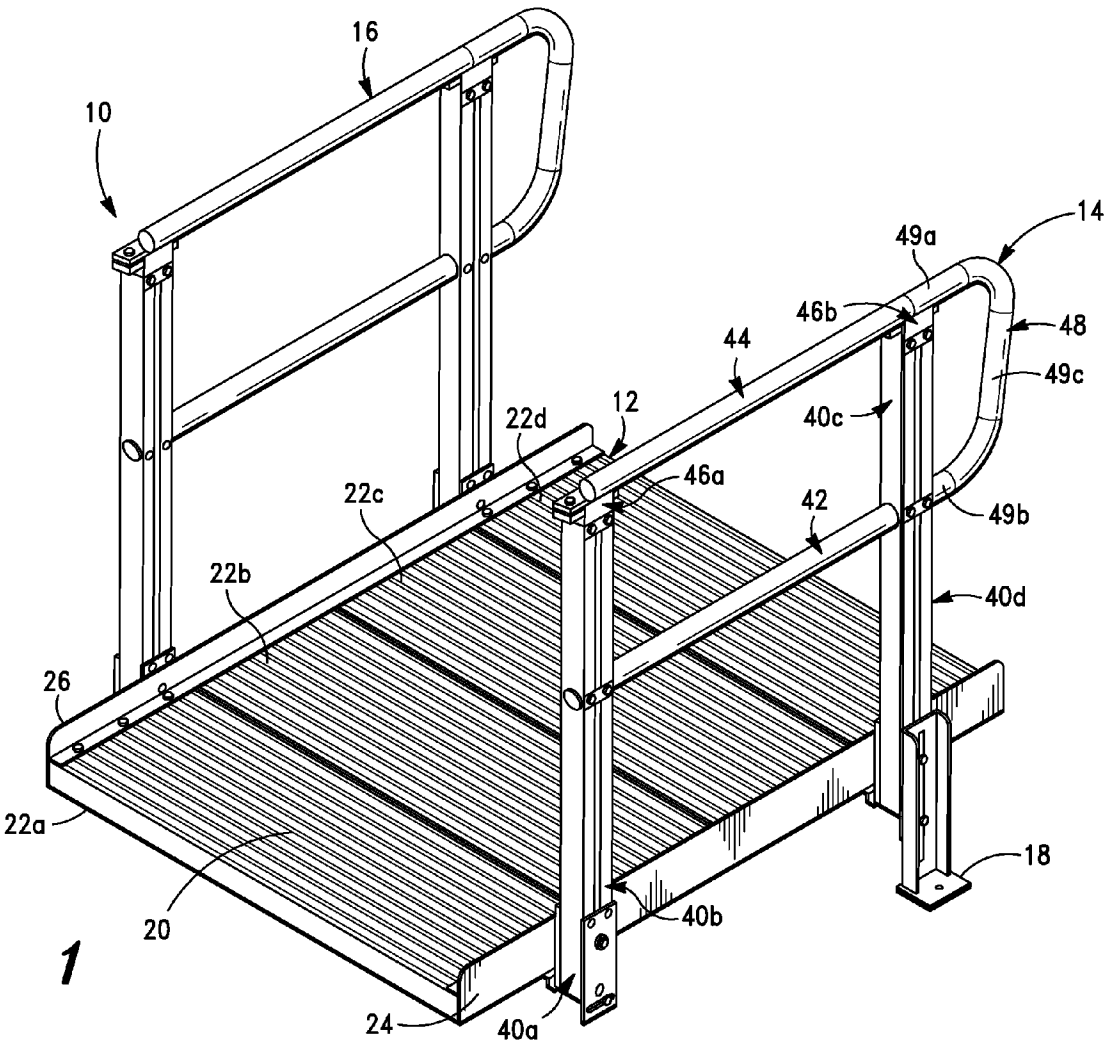
FIG. 1 is a perspective view of a modular ramp assembly in accordance with the present invention.

Referring to FIG. 1, a modular ramp assembly in accordance with the present invention is shown and designated as 10. Modular ramp assembly 10 includes a ramp 12, post and hand rail assemblies 14 and 16 that are each joined to the ramp 12, and legs, one of which is shown as 18, joined to the post and hand rail assemblies 14 and 16 for supporting the ramp 12 above the ground. FIG. 1 shows one exemplary section of modular ramp assembly 10. The ramp assembly 10 may include additional sections joined to the section shown in FIG. 1 in order to extend the ramp assembly 10 to a desired length. Further, the legs 18 are preferably vertically adjustable relative to the ramp 12 in order to incline the ramp 12 so that it extends from the ground at one end to a raised surface at its other end.

Figure 2:
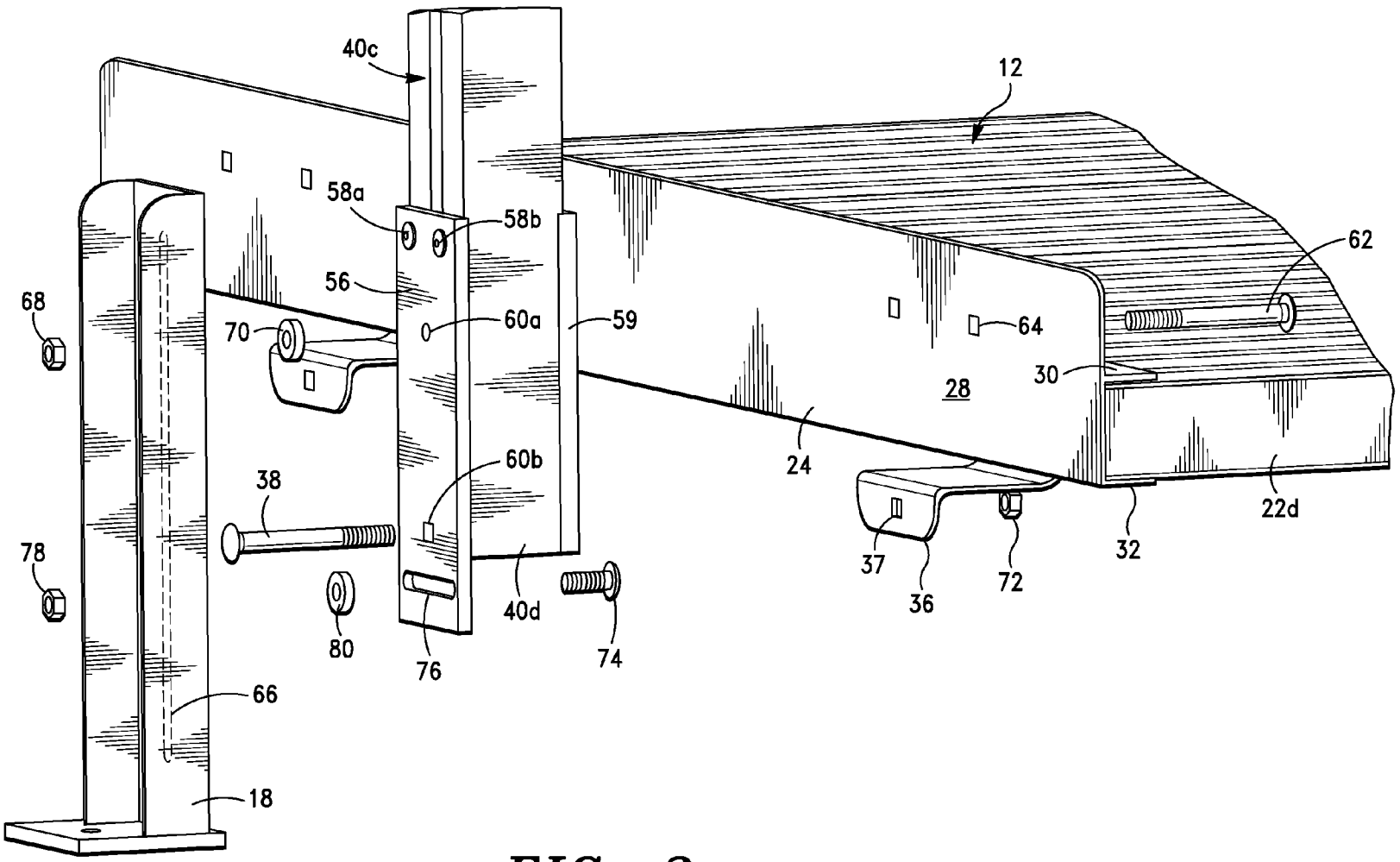
FIG. 2 is an exploded, perspective view of a lower portion of a post, a leg, and a ramp of the assembly of FIG. 1.
Figure 3:
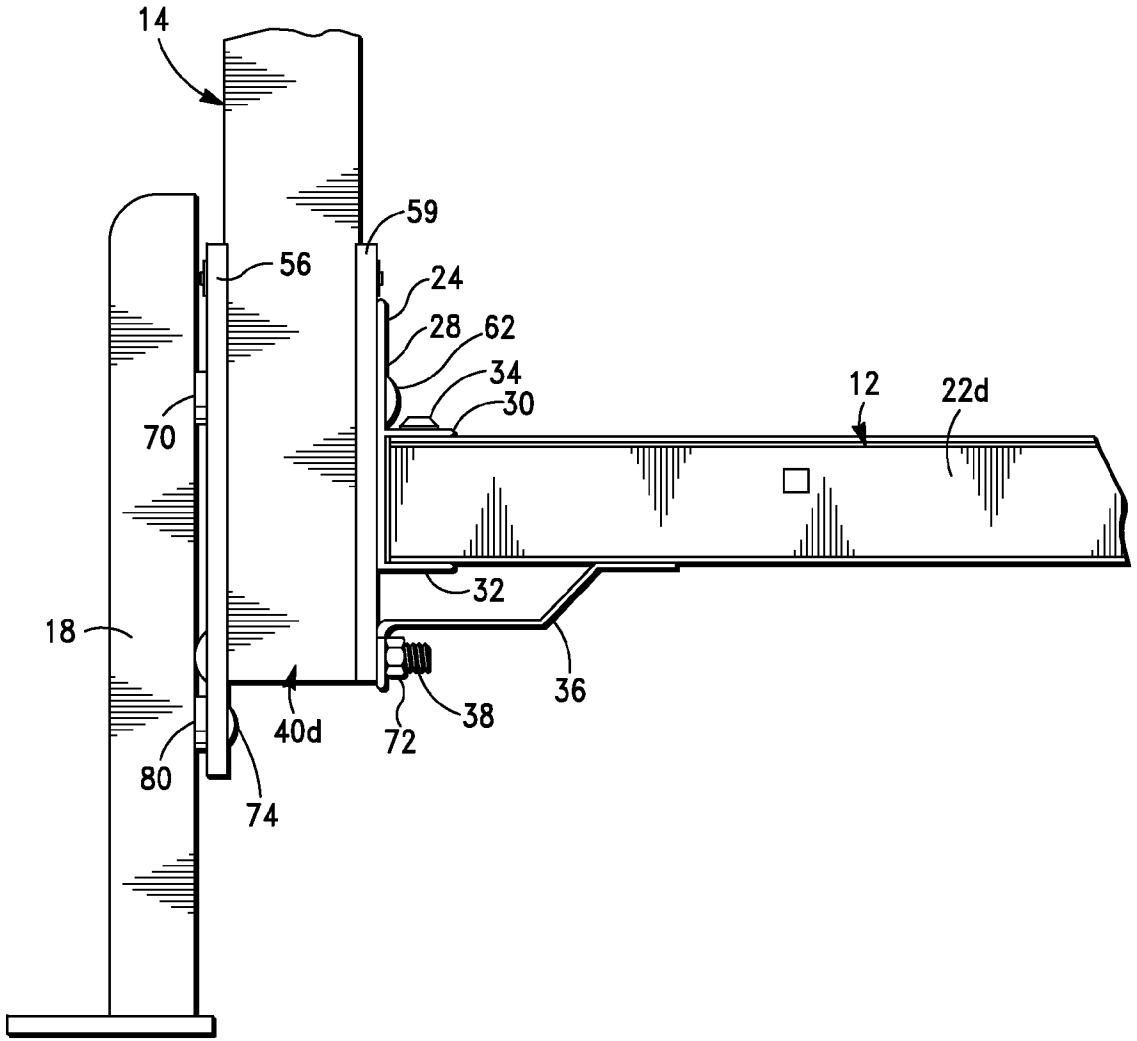
FIG. 3 is a front elevational view of the lower portion of the post and leg mounted to the ramp.

The ramp 12 includes a substantially planar surface 20 formed from four panels 22*a-d*. The panels 22*a-d* are held in place by a pair of frame rails 24 and 26. Referring to FIGS. 2 and 3, frame rail 24 has a vertical wall 28 and a pair of spaced apart horizontal walls 30 and 32 joined to and extending outward from the vertical wall 28. The panels 22*a-d* have a height that is slightly less than the distance between the horizontal walls 30 and 32 such that a side edge of each panel 22*a-d* is received by and slides within the channel formed between the walls 30 and 32. Frame rail 26 has a similar construction as frame rail 24 to receive an opposite side edge of each panel 22*a-d*. Referring to FIG. 3, panel 22*d* is secured to frame rail 24 with a fastener 34. Preferably, two other fasteners join panel 22*d* to frame rail 24 and three fasteners join panel 22*d* to frame rail 26. There are also three fasteners joining panel 22*a* to frame rail 24 and three fasteners joining panel 22*a* to frame rail 26. Panels 22*a* and 22*d* are secured to frame rails 24 and 26 to form a rigid assembly. Panels 22*b* and 22*c* are sandwiched between panels 22*a* and 22*d* and retained within the channels of frame rails 24 and 26 to prevent movement of the panels 22*b* and 22*c*. The ramp 12 may include more or less of panels 22*a-d* depending on the desired length of ramp 12. Panel 22*d* includes a bracket 36 (FIG. 2) extending below the planar surface 20 and outward toward an outer edge of the panel 22*d*. The bracket 36 includes an opening 37 in a surface of the bracket 36 that is aligned with vertical wall 28 of frame rail 24. Opening 37 receives a fastener 38 for joining the ramp 12 to post and hand rail assembly 14. Panel 22*d* preferably includes another bracket (not shown) similar to bracket 36 and extending below the planar surface and outward toward an opposite outer edge of the panel 22*d* for joining ramp 12 to post and hand rail assembly 16 on the opposite side of the ramp 12. Panel 22*a* preferably includes a pair of similar brackets (not shown) for joining post and hand rail assemblies 14 and 16 to opposite sides of ramp 12.

Referring to FIG. 1, post and hand rail assemblies 14 and 16 are substantially the same. Thus, only post and hand rail assembly 14 is described in detail herein. Post and hand rail assembly 14 includes posts 40*a-d*, a lower hand rail section 42 received by openings in the posts 40*b-c*, as described in detail below, an upper hand rail section 44 joined to the posts 40*a-d* with hand rail to post connector assemblies 46*a-b*, as described in more detail below, and a C-shaped end rail section 48. The C-shaped end rail section 48 includes upper and lower generally horizontal portions 49*a* and 49*b* that form a part of upper and lower hand rails, respectively, along with upper hand rail section 44 and lower hand rail section 42. A generally vertical portion 49*c* joins the horizontal portions 49*a* and 49*b*. The upper horizontal portion 49*a* is joined to the posts 40*c-d* with hand rail to post connector assembly 46*b*, and the lower horizontal portion 49*b* is received by openings in post 40*d*, as described in more detail below.

Figure 8:
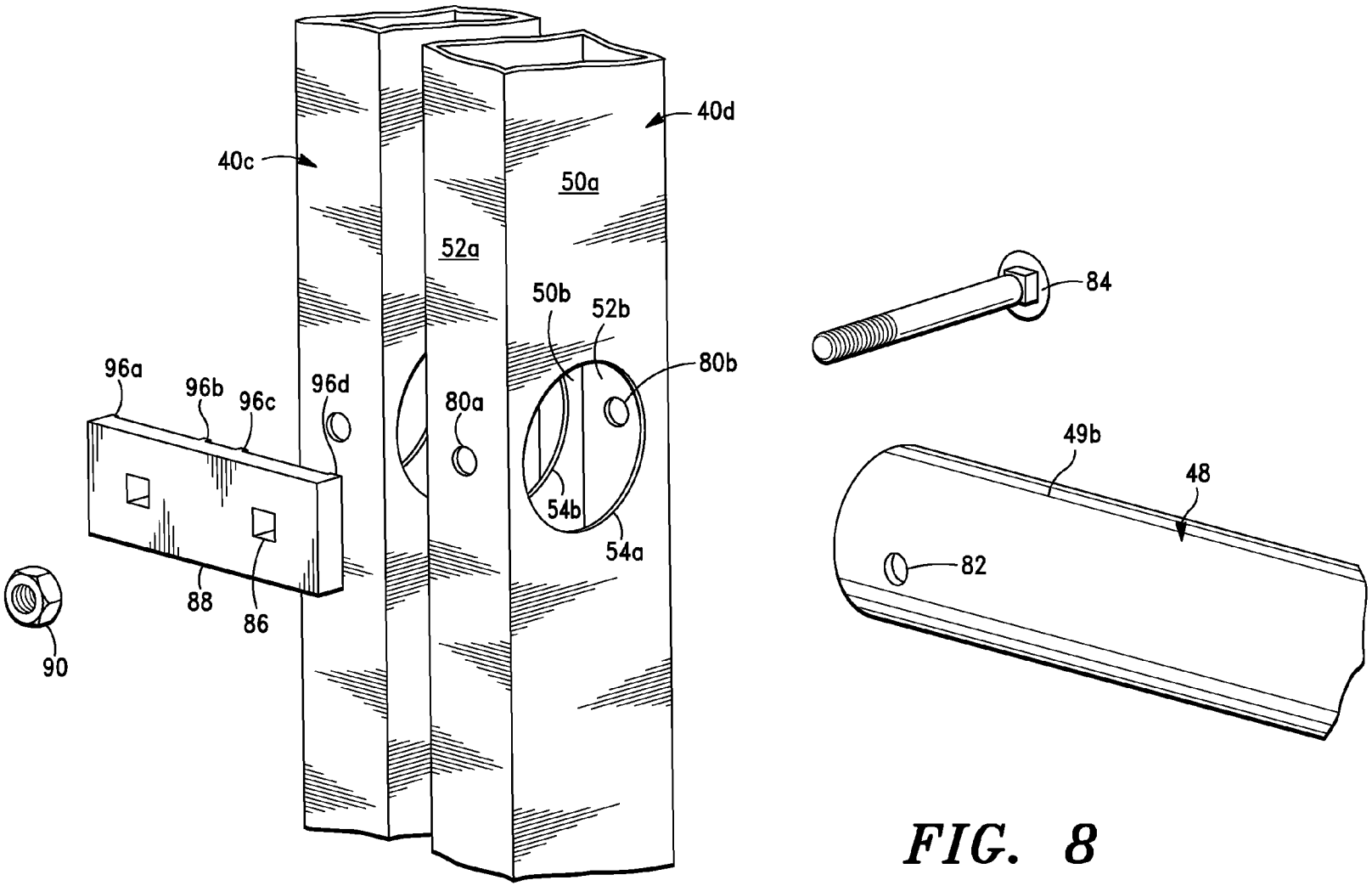
FIG. 8 is an exploded, perspective view of the lower hand rail and post.

Because posts 40*a-d* are substantially similar, only post 40*d* is described in detail herein. Referring to FIG. 8, post 40*d* has side walls 50*a-b* that are joined to end walls 52*a-b* to form a hollow post having a rectangular cross-section. There are a pair of aligned openings 54*a* and 54*b* formed in side walls 50*a* and 50*b*, respectively, for receiving the lower portion 49*b* of end rail section 48, as described in more detail below. Referring to FIG. 2, a bracket 56 is joined to the lower end of posts 40*c* and 40*d* with rivets 58*a-b*. Another bracket 59 is joined to the opposite side of posts 40*c* and 40*d* with rivets (not shown). Bracket 56 includes a pair of spaced apart openings 60*a* and 60*b* that are aligned with similar openings (not shown) in bracket 59. The brackets 56 and 59 join the posts 40*c-d* and space them apart a desired distance.

Referring to FIGS. 2 and 3, leg 18 and posts 40*c* and 40*d* are mounted to frame rail 24 with a bolt 62 that is received by an opening 64 in frame rail 24, opening 60*a* in bracket 56, a similar aligned opening (not shown) in bracket 59, and a slot 66 in leg 18. A nut 68 threaded on bolt 62 secures the leg 18 and posts 40*c-d* to frame rail 24. A washer 70 is received by bolt 62 and is positioned between bracket 56 and leg 18 to space the bracket 56 and leg 18. Bolt 38 passes through opening 60*b* in bracket 56, a similar aligned opening (not shown) in bracket 59, and opening 37 in bracket 36. A nut 72 threaded on bolt 38 secures the posts 40*c* and 40*d* to bracket 36. The head of bolt 38 is positioned between bracket 56 and leg 18 due to the spacing of those parts by washer 70. Another bolt 74 is received by a slot 76 in bracket 56 and slot 66 in leg 18. A nut 78 threaded on bolt 74 secures leg 18 to posts 40*c* and 40*d*. A washer 80 is received by bolt 74 and is positioned between bracket 56 and leg 18 to space the bracket 56 and leg 18 to provide clearance for the head of bolt 38. Referring to FIG. 1, posts 40*a-b* and the posts of hand rail and post assembly 16 are joined to ramp 12 in a similar manner as described above with respect to posts 40*c-d*. Slot 66 in leg 18 permits the leg 18 to be vertically adjustable relative to posts 40*c-d* and ramp 12 depending on the desired vertical height of that section of ramp 12.

Figure 7:
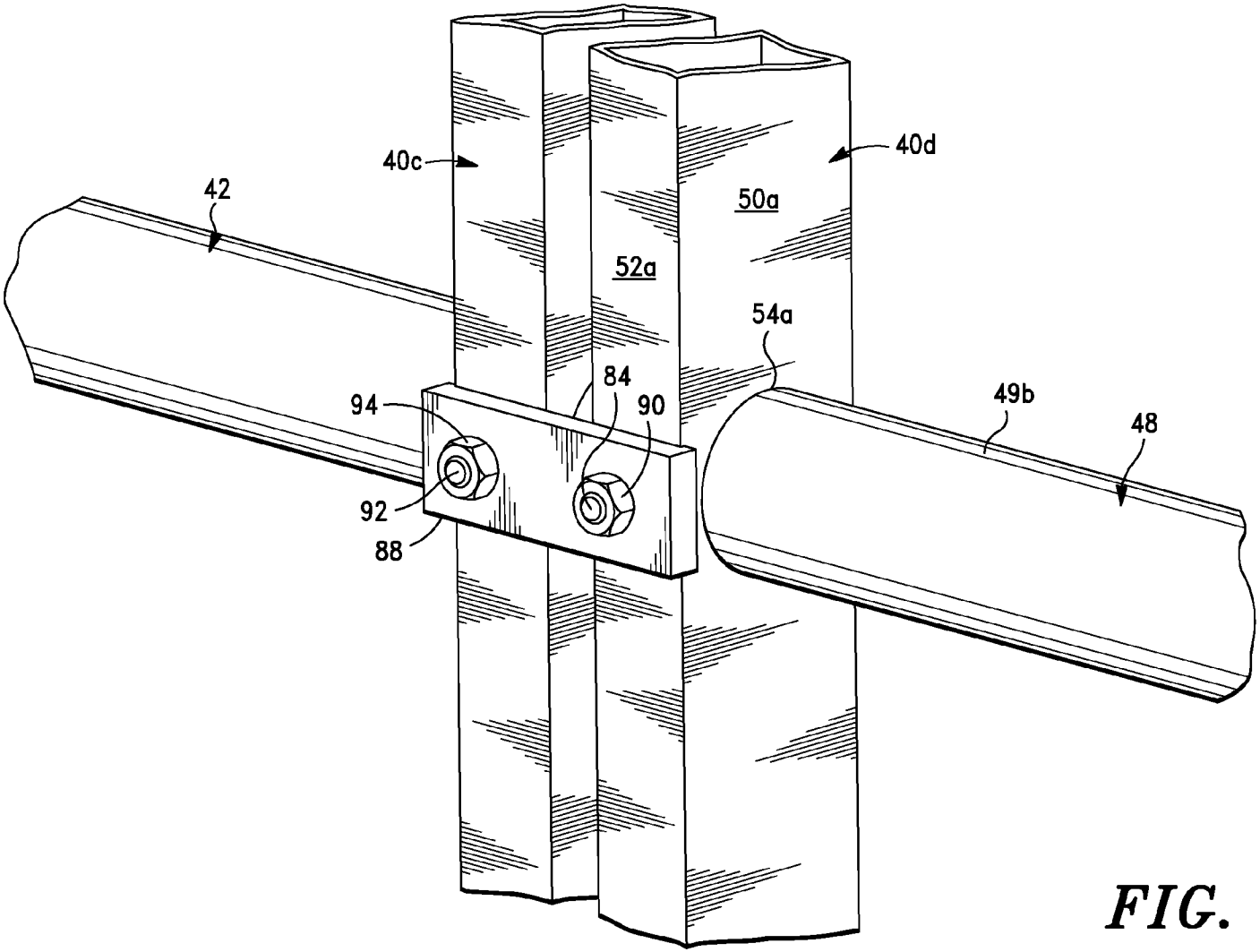
FIG. 7 is a perspective view of a lower hand rail mounted to the post.

Referring to FIGS. 7 and 8, the lower hand rail, which includes lower hand rail section 42 and the lower portion 49*b* of end rail section 48, is secured to posts 40*c* and 40*d*. The lower portion 49*b* of end rail section 48 is received by each of the openings 54*a-b* in post 40*d* so that the portion of side walls 50*a-b* surrounding the openings 54*a-b* supports the lower portion 49*b*. When the lower portion 49*b* is received by openings 54*a-b*, holes 80*a-b* in end walls 52*a-b* are aligned with a pair of holes, one of which is shown as 82, through the side wall of the lower portion 49*b*. A bolt 84 is received by the aligned holes 80*a-b* and 82 in post 40*d* and lower portion 49*b* and by a hole 86 in a post channel bracket 88. A nut 90 engages bolt 84 for securing the end rail section 48 to the post 40*d* and post channel bracket 88. The lower portion 49*b* extends through both of the openings 54*a-b* and is supported by both of the side walls 50*a-b* of post 40*d* in order to support the lower portion 49*b* and substantially prevent it from moving with respect to the post 40*d* when joined thereto with bolt 84 and nut 90. The lower hand rail section 42 is received by two openings in post 40*c*, supported by both side walls of post 40*c*, and secured to the post 40*c* and post channel bracket 88 with a bolt 92 and nut 94 in a similar manner. The surface of post channel bracket 88 facing posts 40*c* and 40*d* has four ridges 96*a-d*, which are spaced apart to define a pair of channels that are each slightly wider than one of posts 40*c-d*. Each post 40*c-d* is received by one of the channels formed by ridges 96*a-d* to rigidly secure the posts 40*c-d* together and space them apart a desired distance. Providing two posts 40*c* and 40*d* at the location where lower hand rail section 42 and lower portion 49*b* of end rail section 48 meet allows the lower hand rail section 42 to be supported by both side walls of post 40*c* and the end rail section 48 to be supported by both side walls of post 40*d* in order to substantially prevent movement of the lower hand rail section 42 and end rail section 48. Referring to FIG. 1, lower hand rail section 42 is joined to post 40*b* in a similar manner, and another lower hand rail section (not shown) may be joined to and extend away from post 40*a* in a similar manner.

Figure 4:
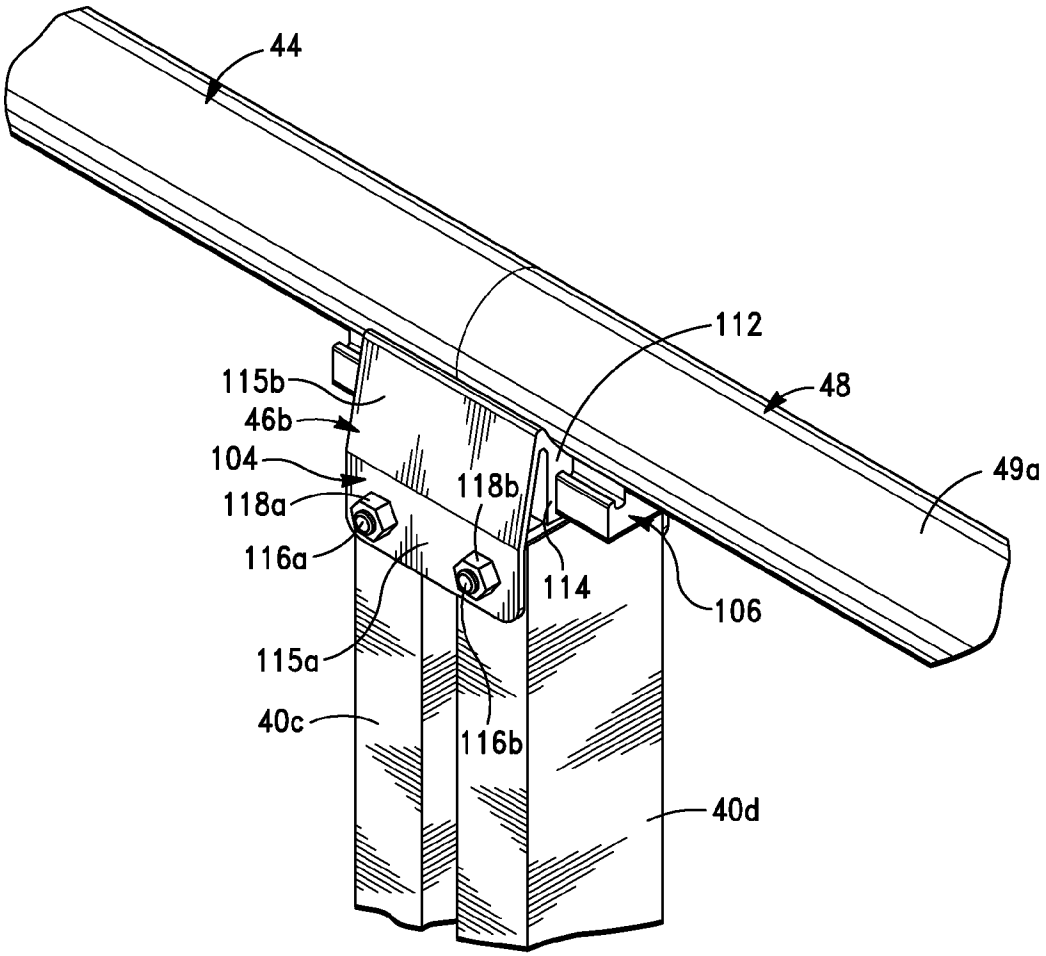
FIG. 4 is a perspective view of an upper hand rail mounted to an upper portion of the post with a hand rail to post connector assembly.
Figure 5:
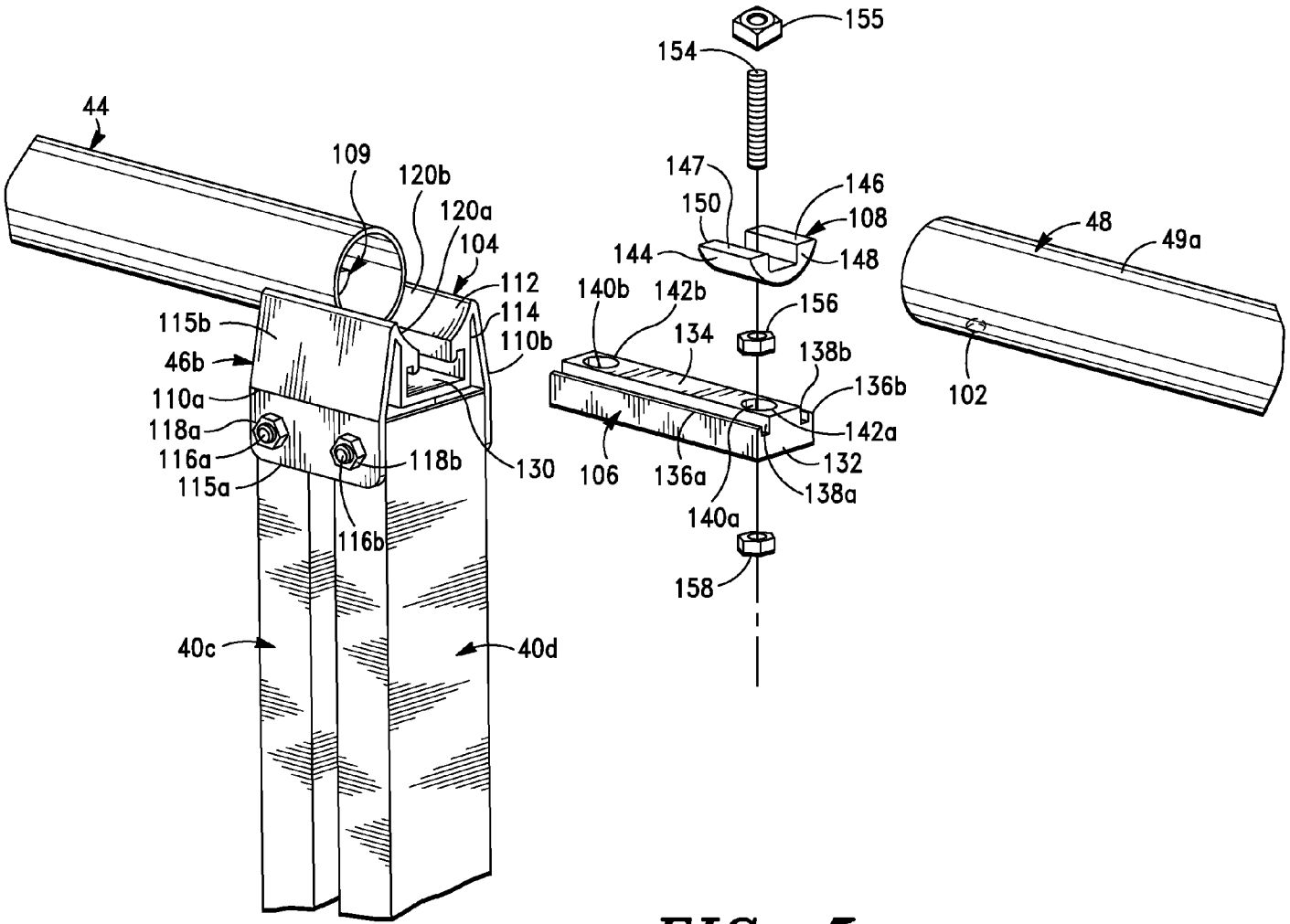
FIG. 5 is an exploded, perspective view of the upper hand rail, upper portion of the post, and hand rail to post connector assembly.
Figure 6:
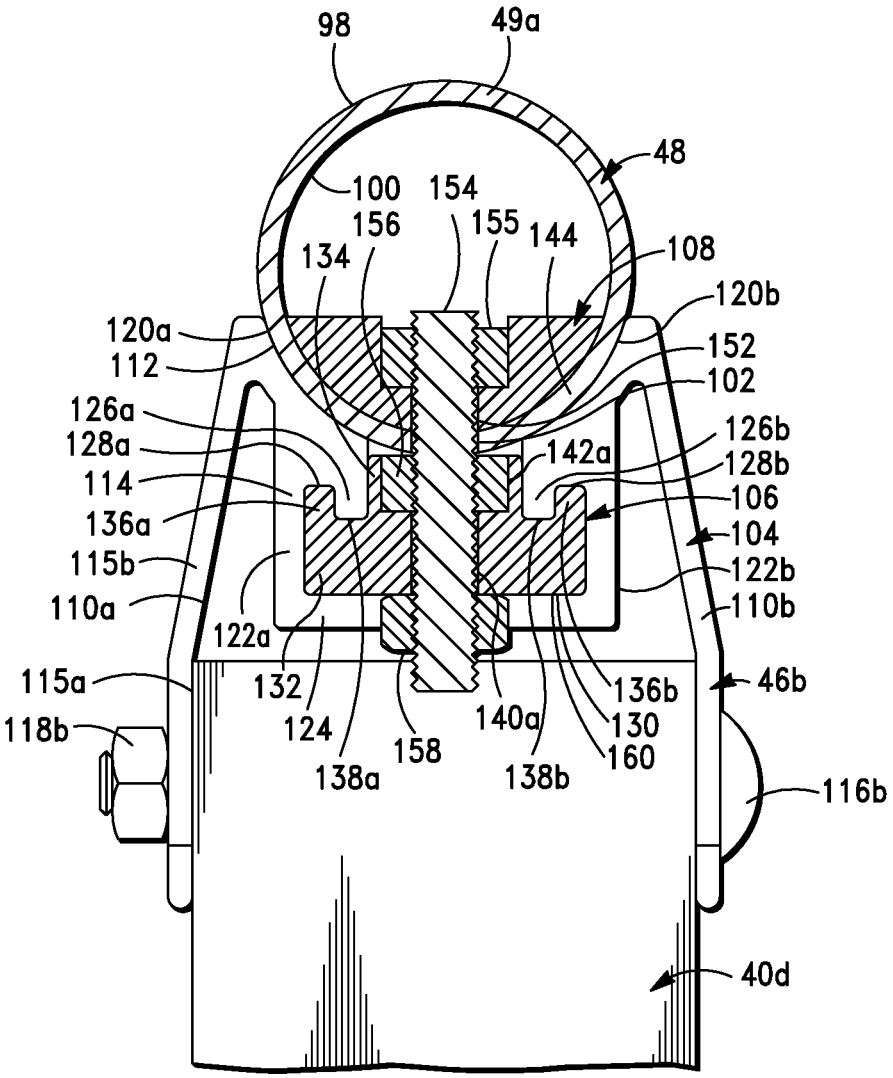
FIG. 6 is a cross-sectional view of the upper hand rail, upper portion of the post, and hand rail to post connector assembly.

Referring to FIGS. 4-6, the upper hand rail, which includes upper hand rail section 44 and the upper portion 49*a* of end rail section 48, is secured to posts 40*c* and 40*d* with hand rail to post connector assembly 46*b*. The upper hand rail section 44 is secured to posts 40*a-b* with hand rail to post connector assembly 46*a* in a similar manner, as shown in FIG. 1, and another upper hand rail section (not shown) may be joined to hand rail to post connector assembly 46*a* in a similar manner. Accordingly, only the connection between upper portion 49*a*, upper hand rail section 44, and posts 40*c-d* is described in detail herein. The upper portion 49*a* of end rail section 48 is a tube having a circular cross-section with an outer surface 98 and an inner surface 100 (FIG. 6). There is a hole 102 (FIG. 5) through the upper portion 49*a* adjacent an end of the upper portion 49*a*.

Hand rail to post connector assembly 46*b* includes a post cap 104 that is mounted to an upper end of posts 40*c* and 40*d*, a saddle 106 that is slideably received by post cap 104, a rail insert 108 that is received within the upper portion 49*a* of end rail section 48, and another rail insert 109 (FIG. 5) that is received within the upper hand rail section 44. Hand rail to post connector assembly 46*a* is substantially the same as hand rail to post connector assembly 46*b* and thus is not described in detail herein.

Post cap 104 has opposed side walls 110*a-b*, a support surface 112 that is joined with and extends downward from an upper edge of the side walls 110*a-b*, and a locking structure 114 that is coupled with and extends downward from support surface 112. Each side wall 110*a-b* has a generally vertical lower portion 115*a* and an upper portion 115*b* that extends upward at an incline from the lower portion 115*a* toward the other side wall 110*a-b*. The lower portions 115*a* of the side walls 110*a-b* are spaced apart by a distance that is slightly larger than the width of posts 40*c* and 40*d* so that the posts 40*c* and 40*d* fit within the side walls 110*a-b*. The side walls 110*a-b* are mounted to upper ends of the posts 40*c-d* with bolts 116*a-b* that are received by aligned openings (not shown) in the side walls 110*a-b* and posts 40*c-d*. Nuts 118*a-b* engage the threads on bolts 116*a-b*.

The support surface 112 includes a pair of curved sections 120*a-b* each extending downward from one of side walls 110*a-b* toward the other curved section 120*a-b*. There is a gap between the curved sections 120*a-b* such that the support surface 112 is not continuous. The support surface 112 is curved to match and closely conform to the curvature of the outer surface 98 of the end rail section 48. The support surface 112 supports the upper portion 49*a* of end rail section 48 in order to prevent downward movement of the upper hand rail. The curvature of the support surface 112 also substantially prevents lateral movement of the upper portion 49*a* because the support surface 112 surrounds approximately one half of the upper portion 49*a*. Referring to FIG. 6, locking structure 114 includes a pair of side walls 122*a-b* extending downward from curved sections 120*a-b* and a bottom wall 124 extending between and joining the side walls 122*a-b*. Locking structure 114 also includes a pair of ridges 126*a-b* extending downward from curved sections 120*a-b* and spaced apart from side walls 122*a-b* to form slots 128*a-b* between the ridges 126*a-b* and side walls 122*a-b*. The locking structure 114 defines a slot 130 positioned below the support surface 112 that slideably receives saddle 106 in a substantially horizontal direction to substantially constrain saddle 106 from moving vertically.

Referring to FIGS. 5 and 6, saddle 106 includes a base 132 having a rectangular cross-section, a middle ridge 134 extending upward from the base 132, and side ridges 136*a-b* extending upward from the base 132 and spaced from the middle ridge 134 to form slots 138*a-b* between the middle ridge 134 and side ridges 136*a-b*. When saddle 106 is received by locking structure 114, base 132 is received by slot 130 of locking structure 114, middle ridge 134 extends upward into the gap between curved sections 120*a-b*, side ridges 136*a-b* of saddle 106 are received by slots 128*a-b* of locking structure 114, and ridges 126*a-b* of locking structure 114 are received by slots 138*a-b* of saddle 106. The interlocking ridges 126*a-b* of locking structure 114 and ridges 134 and 136*a-b* of saddle 106 substantially prevent the saddle 106 from moving with respect to the post cap 104 in any direction other than horizontally through the slot 130. The saddle 106 has first and second openings 140*a-b* that pass vertically through the middle ridge 134. First opening 140*a* of saddle 106 aligns with opening 102 in upper portion 49*a* of end rail section 48 and second opening 140*b* aligns with an opening (not shown) in upper hand rail section 44. Recesses 142*a-b* are formed in an upper surface of the middle ridge 134 surrounding openings 140*a-b*. The saddle 106 is longer than the post cap 104 such that the portions of the saddle 106 including first and second openings 140*a-b* extend laterally from opposite ends of the post cap 104.

Referring to FIG. 5, rail insert 108 has a bottom clamping surface 144, a top horizontal surface 146 with a groove 147 formed therein, and side surfaces 148 and 150. A hole 152 passes vertically through top surface 146 at groove 147 and clamping surface 144. Referring to FIG. 6, rail insert 108 is received within the end rail section 48, and clamping surface 144 engages inner surface 100. The clamping surface 144 has the same curvature as the inner surface 100 so that the clamping surface 144 closely conforms to the inner surface 100 to form a tight fit between the two surfaces. The rail insert 108 includes a threaded rod 154 that engages the threads on a square nut 155, which is received by groove 157 (FIG. 5). Referring to FIGS. 5 and 6, threaded rod 154 passes through hole 152, hole 102 in end rail section 48, engages the threads on a first nut 156, passes through the first opening 140*a* in saddle 106, and engages the threads on a second nut 158. The first nut 156 is received by the recess 142*a* in saddle 106, which is sized so that the first nut 156 fits tightly within it. The first nut 156 is positioned adjacent outer surface 98 in the gap between the curved sections 120*a-b* of support surface 112. The rail insert 108 is secured to saddle 106 via second nut 158 which abuts a lower surface 160 of the saddle 106 and clamps end rail section 48 between rail insert 108 and saddle 106.

Tightening second nut 158 moves the clamping surface 144 of rail insert 108 toward the inner surface 100 of end rail section 48 and the outer surface 98 of end rail section 48 toward the support surface 112 of post cap 104, which clamps the end rail section 48 between the rail insert 108 and post cap 104. Clamping the end rail section 48 between the rail insert 108 and post cap 104 in this manner substantially prevents vertical movement of the end rail section 48 relative to posts 40*c* and 40*d*, and substantially prevents lateral movement of the end rail section 48 relative to posts 40*c* and 40*d* in a direction that is transverse to the direction in which saddle 106 slides within post cap 104. The second nut 158 and portion of threaded rod 154 positioned below saddle 106 are positioned adjacent the side of post 40*d* and post cap 104 preventing movement of the saddle 106, rail insert 108 and end rail section 48 relative to the post cap 104 in the same direction as the direction in which saddle 106 slides within post cap 104.

Rail insert 109 has a similar structure as rail insert 108 and clamps the upper hand rail section 44 to post cap 104 and saddle 106 in a similar manner as described above with respect to rail insert 108 and end rail section 48. Thus, rail insert 109 has a threaded rod (not shown) that is received by an opening (not shown) in upper hand rail section 44 and the second opening 140*b* in saddle 106. A first nut (not shown) engages the threaded rod and is received within the recess 142*b* of saddle 106, a second nut (not shown) engages the threaded rod and abuts the lower surface 160 of saddle 106 to clamp the upper hand rail section 44 to post cap 104, and a third nut (not shown) is received by an upper portion of the threaded rod and received by a groove in the rail insert 109. The threaded rod and second nut extend below saddle 106 in a similar manner as threaded rod 154 and nut 158 (shown in FIG. 6), and are positioned adjacent the side of post 40*c* and post cap 104 preventing movement of the saddle 106, rail insert 108 and end rail section 48 relative to the post cap 104 in the same direction as the direction in which saddle 106 slides within post cap 104.

The side walls 110*a-b*, support surface 112, and locking structure 114 of post cap 104 are preferably solid and thicker than the walls of posts 40*c-d*, upper hand rail section 44, and end rail section 48 to provide more strength and support to the hand rail to post connector assembly 46*b*. Saddle 106 and rail inserts 108 and 109 are preferably constructed as solid parts, which increases their weight and rigidity and allows them to clamp upper hand rail section 44 and end rail section 48 with more force. The ramp 12, leg 18, posts 40*a-d*, lower hand rail section 42, upper hand rail section 44, end rail section 48, post cap 104, saddle 106, and rail inserts 108 and 109 are preferably made from a rigid material such as aluminum. However, it is within the scope of the invention for these parts to be made from other materials. As shown in FIG. 6, the rail insert 108 has a nut 158 and portion of threaded rod 154 extending below saddle 106, and the other rail insert 109 has a similar nut (not shown) and threaded rod (not shown) extending below saddle 106, which nuts and rods are positioned adjacent opposite sides of posts 40*c* and 40*d* to prevent the saddle 106, rail inserts 108 and 109, upper hand rail section 44, and end rail section 48 from sliding with respect to post cap 104. These features allow the hand rail to post connector assembly 46*b* to securely join the upper hand rail section 44 and end rail section 48 to the posts 40*c* and 40*d* and prevent movement of the upper hand rail section 44 and end rail section 48.

The structure of the ramp assembly 10 described above and shown in the drawings makes the assembly 10 modular so that it is adaptable for use in different circumstances and locations. For example, the upper and lower hand rail sections 42 and 44 may each be manufactured in a number of different lengths, and the pairs of posts 40*a-b* and 40*c-d* may be spaced apart a desired distance corresponding to a particular chosen length of hand rail section. An installer may choose a desired length of hand rail section and post spacing in order to adapt the ramp assembly 10 to fit in a particular location where the ramp assembly 10 is being installed. Multiple ramp assembly sections such as the ramp assembly 10 shown in FIG. 1 may be joined together to form a ramp assembly of a desired length as dictated by the location where the ramp assembly is being installed. The modular nature of the ramp assembly 10 permits an installer to transport the ramp assembly 10 in sections or individual parts from where they are manufactured and/or stored to where they are finally installed or assembled. Because the individual parts of the ramp assembly 10 may be transported in an unassembled manner, a single installer may load the parts on a truck for transport and unload them for assembly. Further, because the upper and lower hand rails, including sections 42, 44, and 48, are removably joined to the posts 40*a-d*, the upper and lower hand rails may be painted separate from the posts 40*a-d*, which may remain unpainted.

In operation, the individual components of ramp assembly 10 may be transported in an unassembled state to the location where they will be installed. The panels 22*a-d* of ramp 12 slide into frame rails 24 and 26, and panels 22*a* and 22*d* are joined to the frame rails 24 and 26 with fasteners 34. The frame rails 24 and 26 may be longer or shorter than the rails shown in FIG. 1 and be adapted to hold more or less of panels 22*a-d* depending on the desired length of ramp assembly 10. Pairs of posts 40*a-b* and 40*c-d* are joined to the frame rail 24 with fasteners 38 and 62 in the manner described above and shown in FIGS. 2 and 3. If desired, legs 18 are also joined to the pairs of posts 40*a-b* and 40*c-d* with fasteners 62 and 74. The lower hand rail section 42 and end rail section 48 are joined to posts 40*c-d* with fasteners 84 and 92 and bracket 88 as described above and shown in FIGS. 7 and 8. The lower hand rail section 42 and another hand rail section (not shown) are joined to posts 40*a-b* in a similar manner.

The upper hand rail section 44 and end rail section 48 are joined to the posts 40*c-d* with hand rail to post connector assembly 46*b* as described herein. Referring to FIGS. 5 and 6, post cap 104 is fastened to posts 40*c* and 40*d* with fasteners 116*a-b*. Rail insert 108 is placed within the end rail section 48, and nut 155 is positioned within groove 147. The threaded rod 154 is placed through hole 102 and threaded into engagement with nut 155. First nut 156 is threaded on rod 154 to retain rail insert 108 in place within end rail section 48. Rail insert 109 is placed within upper hand rail section 44 and secured thereto with a nut (not shown) in a similar manner as described with respect to rail insert 108. Saddle 106 then slides into the slot 130 in post cap 104 such that the portions of saddle 106 including first and second openings 140*a-b* extend laterally from opposite ends of the post cap 104. Threaded rod 154 of rail insert 108 is received by opening 140*a* and first nut 156 is received by recess 142*a*. Likewise, the threaded rod (not shown) of rail insert 109 is received by opening 140*b* and the first nut (not shown) of rail insert 109 is received by recess 142*b*. Second nut 158 engages threaded rod 154 and is tightened to secure the end rail section 48 to posts 40*c* and 40*d*. The second nut (not shown) of rail insert 109 is secured to a threaded rod (not shown) to secure upper hand rail section 44 to posts 40*c* and 40*d* in a similar manner. Upper hand rail section 44 and another hand rail section (not shown) are joined to posts 40*a-b* with hand rail to post connector assembly 46*a* in a similar manner as described above with respect to hand rail to post connector assembly 46*b*. The post and hand rail assembly 16 shown in FIG. 1 is assembled and joined to ramp 12 in a similar manner as described with respect to post and hand rail assembly 14.

Although the preferred embodiment of modular ramp assembly 10 described above and shown in the drawings includes tubular hand rails with circular cross-sections, such as lower and upper hand rail sections 42 and 44 and end rail section 48, it is within the scope of the invention for the hand rails to have other shapes. For example, the hand rails may have a square or elliptical cross-section. In the event that the hand rails have a non-circular cross-section, the rail inserts 108 and 109 are preferably modified to have a bottom clamping surface 144 which matches the inner surface of the hand rails so that the rail inserts 108 and 109 closely conform to and fit tightly within the hand rails. Further, the support surface 112 of the post cap 104 would also be modified to match the outer surface of the hand rails in order to closely conform to and fit tightly against the hand rails.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A hand rail to post connector assembly, comprising:

a post cap configured for mounting to a post, wherein said post cap comprises a support surface configured to support a hand rail, and a slot positioned below said support surface;

a saddle configured to be received by said slot such that said post cap substantially constrains said saddle from moving vertically; and a rail insert comprising a clamping surface configured to engage an inner surface of a hand rail, wherein said rail insert is configured to be secured to said saddle for clamping the hand rail between said rail insert and said saddle.

2. The assembly of claim 1, wherein said post cap comprises a locking structure that is coupled with and extends downward from said support surface, wherein said locking structure defines said slot.

3. The assembly of claim 2, wherein said post cap comprises opposed side walls each coupled with said support surface, wherein said side walls are configured for mounting to a post.

4. The assembly of claim 1, wherein said support surface is configured to prevent lateral and downward movement of the hand rail.

5. The assembly of claim 1, wherein said support surface is curved for supporting a hand rail having a circular cross-section.

6. The assembly of claim 1, wherein said slot is configured to slideably receive said saddle in a substantially horizontal direction.

7. The assembly of claim 1, wherein said saddle comprises an opening that is configured to align with an opening in the hand rail, and wherein said rail insert comprises a protrusion that extends downward from said clamping surface and is received by the aligned openings.

8. The assembly of claim 7, wherein said protrusion comprises a threaded fastener which engages a first nut that abuts a lower surface of said saddle for clamping the hand rail between said rail insert and said saddle.

9. The assembly of claim 8, wherein said saddle comprises an upper surface with a recess formed therein that surrounds said opening in said saddle, and further comprising a second nut that engages said threaded fastener and is received by said recess.

10. The assembly of claim 7, wherein said saddle is longer than said post cap such that a portion of said saddle including said opening extends laterally from said post cap.

11. The assembly of claim 1, wherein said rail insert is configured to be received within a hand rail.

12. The assembly of claim 1, wherein said clamping surface is curved for engaging the inner surface of a hand rail having a circular cross-section.

13. The assembly of claim 1, further comprising a second rail insert comprising a clamping surface configured to engage an inner surface of a second hand rail, wherein said second rail insert is configured to be secured to said saddle for clamping the second hand rail between said second rail insert and said saddle.

14. A post and hand rail assembly, comprising:

a post;

a post cap mounted to said post, wherein said post cap comprises a support surface and a slot positioned below said support surface;

an upper hand rail comprising an outer surface that is supported by said support surface and an inner surface;

a saddle that is configured to be received by said slot such that said post cap substantially constrains said saddle from moving vertically; and a rail insert comprising a clamping surface engaging said inner surface of said upper hand rail, wherein said rail insert is secured to said saddle for clamping said upper hand rail between said rail insert and said saddle.

15. The assembly of claim 14, wherein said post comprises opposed side walls each having an opening, and further comprising a lower hand rail that is received by said opening in each of said side walls.

16. The assembly of claim 15, further comprising a second post mounted to said post cap, wherein said second post comprises opposed side walls each having an opening, and further comprising a second lower hand rail that is received by said opening in each of said side walls of said second post.

17. The assembly of claim 16, further comprising a post channel coupled with said post and said lower hand rail via a first fastener that is received by aligned holes in said post channel, said post, and said lower hand rail, and wherein said post channel is coupled with said second post and said second lower hand rail via a second fastener that is received by aligned holes in said post channel, said second post, and said second lower hand rail.

18. The assembly of claim 16, further comprising a second upper hand rail comprising an outer surface that is supported by said support surface and an inner surface, and a second rail insert comprising a clamping surface engaging said inner surface of said second upper hand rail, wherein said second rail insert is secured to said saddle for clamping said second upper hand rail between said second rail insert and said saddle.

19. The assembly of claim 18, wherein said saddle comprises a first opening that aligns with an opening in said upper hand rail and a second opening that aligns with an opening in said second upper hand rail, wherein said rail insert comprises a protrusion that extends downward from said clamping surface and is received by the aligned first opening and opening in said upper hand rail, and wherein said second rail insert comprises a protrusion that extends downward from said clamping surface and is received by the aligned second opening and opening in said second upper hand rail.

20. The assembly of claim 19, wherein said saddle is longer than said post cap such that a portion of said saddle including said first opening extends laterally from one end of said post cap and a portion of said saddle including said second opening extends laterally from another end of said post cap.

21. A modular ramp assembly, comprising:

a ramp comprising a substantially planar surface and a pair of frame rails each joined with one side of said planar surface;

a post mounted to one of said frame rails;

a post cap mounted to said post, wherein said post cap comprises a support surface and a slot positioned below said support surface;

an upper hand rail comprising an outer surface that is supported by said support surface and an inner surface;

a saddle that is configured to be received by said slot such that said post cap substantially constrains said saddle from moving vertically; and a rail insert comprising a clamping surface engaging said inner surface of said upper hand rail, wherein said rail insert is secured to said saddle for clamping said upper hand rail between said rail insert and said saddle.

* * * * *